US007437855B2

(12) United States Patent
Locke et al.

(10) Patent No.: US 7,437,855 B2
(45) Date of Patent: Oct. 21, 2008

(54) WATER AND WATER VAPOR STRUCTURAL BARRIER

(76) Inventors: David D. Locke, 8038 Douglas Ranch Dr., Granite Bay, CA (US) 95746; Kurt S. Chirbas, 9806 Beckenham Dr., Granite Bay, CA (US) 95746

( * ) Notice: Subject to any disclaimer, the term of this patent is extended or adjusted under 35 U.S.C. 154(b) by 537 days.

(21) Appl. No.: 10/843,711

(22) Filed: May 12, 2004

(65) Prior Publication Data

US 2004/0226237 A1 Nov. 18, 2004

Related U.S. Application Data

(60) Provisional application No. 60/470,623, filed on May 16, 2003.

(51) Int. Cl.
*E02D 19/00* (2006.01)

(52) U.S. Cl. ..... 52/169.14; 52/62; 52/169.5

(58) Field of Classification Search ..... 52/250, 52/396.04, 396.08, 362, 480, 309.11, 306.02, 52/62, 169.5, 606, 57, 412, 413, 461, 466
See application file for complete search history.

(56) References Cited

U.S. PATENT DOCUMENTS 2,858,695 A * 11/1958 Loughborough ..... 52/396.02
4,467,587 A * 8/1984 Montagnan ..... 52/169.14
5,303,523 A * 4/1994 Hand et al. ..... 52/101
5,694,723 A * 12/1997 Parker ..... 52/169.5
5,771,643 A * 6/1998 Parker ..... 52/169.5
5,927,023 A * 7/1999 Kittilstad ..... 52/60
6,244,001 B1 * 6/2001 Anastasi ..... 52/215
6,308,470 B1 * 10/2001 Durkovic ..... 52/169.5

* cited by examiner

*Primary Examiner*—Richard E. Chilcot, Jr.
*Assistant Examiner*—Anthony N Bartosik
(74) *Attorney, Agent, or Firm*—Edward E. Roberts

(57) ABSTRACT

The invention discloses an improved seal for providing protection against water, water vapor, and other vapors from entering into and permeating through a concrete slab. The seal includes three primary functional edges extending from a common junction, a first edge positioned substantially horizontally to be moisture proof fastened to a geo-membrane liner over which a slab is to be poured, a second edge extending downwardly to the first edge to be embedded into a foundation, and a third edge extending upwardly from the first edge to be embedded into the slab. The invention applies to both monolithic and non-monolithic pours.

5 Claims, 6 Drawing Sheets

WATER AND WATER VAPOR STRUCTURAL BARRIER

CLAIM FOR BENEFIT OF EARLIER FILING DATE

This application claims the benefit of U.S. Provisional Application No. 60/470,623 filed on 16 May 2003 and entitled "Water and Water Vapor Structural Barrier". This utility application has the same inventors, subject matter and title as the said Provisional Application.

BACKGROUND

The background of the invention will be discussed in two parts:

1. Field of the Invention

This invention relates to water and water vapor proofing and more particularly to the fastening and sealing of a geosynthetic membrane under a concrete slab and/or to footings of an on grade or below grade foundation under any structure, to seal off water and water vapor at the joints between the foundation and slab and the areas directly under the slab foundation.

2. Description of the Related Art

Water and water vapor proofing of on grade or below grade concrete slab floor is an essential consideration during construction of residential, commercial and industrial structures. Evapo-transportation of molecular water from the subsoil to a water vapor state and transportation of the water vapor by vapor drive through the capillaries of the concrete foundation is a naturally occurring event. The water vapor molecules pick up the concrete salts through osmosis as they pass through the capillaries of the concrete and then pass through the carbonated cement paste of the concrete foundation to escape into the atmosphere of the structure. When water vapor molecules encounter a non-permeable or sufficiently dense structure the water vapor molecules convert back to water molecules. Since the water vapor molecules carried the salts of the concrete, the water molecules have an increase in pH to as high as 14. This combination of elevated water vapor transmission through the concrete foundation and the resulting increase in the pH of the water molecules presents the leading cause of adhesive, flooring and coating failures for above grade and below grade concrete slabs. These failures contribute floor covering problems such as adhesion loss, warping, peeling, buckling, staining, offensive odors and mold growth.

Traditionally, newly constructed structures require a moisture/vapor barrier such as polyethylene sheeting that is placed directly under an on grade or below grade concrete floor slabs. However, these polyethylene liners alone are inadequate in restriction of water and water vapor through concrete floor slabs for at least the following reasons:

1) Water/vapor will pass through the lap seams of the sheeting.

2) Water/vapor will pass through plumbing/electrical openings of on grade foundations.

3) Water/vapor will pass through the perimeter and interior of the foundation and throughout the plumbing and electrical trenches.

4) The durability of polyethylene sheeting under on grade foundations as a water/vapor barrier is questionable in that it cannot withstand the normal construction activities surrounding on grade or below grade foundation installation, i.e., it will puncture under normal foot traffic.

Another consideration is that water vapor molecules can pass through standard 6 to 10 mil polyethylene sheeting, which is the minimum requirement specified by the Uniform Building Code.

The prior art includes various approaches for providing a barrier to moisture permeation from the subsoil to above-slab coverings. One such approach is disclosed in U.S. Pat. No. 6,189,279, entitled Floating Floor Underlay, issued to Fiehtl on Feb. 20, 2001, that discloses a composite underlay product for a floating floor. This product is made from a vinyl film (like polyethylene) that creates a moisture impermeable underlay when laid over a wood or concrete sub-floor. The seams between butting sheets of the underlay are sealed with moisture impermeable tape. Another prior art patent is U.S. Pat. No. 5,376,429, entitled Laminated Water Stop Bentonite and Bentones, issued to Mcgroarty on Dec. 27, 1994, that discloses a water/water vapor barrier between the concrete footing and slab using a strip of Bentonite tape for a seal, the seal installed without changes to the concrete installation.

Thus, in view of the known prior art, an apparatus and method is needed that will provide an improved water/water vapor barrier that prevents permeation of water/water vapor through an on grade or below grade floor concrete floor slab. Applicants' invention provides such a barrier. The invention provides means for sealing of polyethylene liners at termination points as well as a water/water vapor seal barrier at the cold joints between the footing and slab that restricts intrusion of gases, vapors, liquids and insects without requiring revised construction practices, other than the wet setting of the water/water vapor seal into the concrete footing or direct placement within the concrete form work.

SUMMARY

The invention provides an apparatus and method for improved protection against water, water vapor and other liquids and gases from entering into and permeating through on grade or below grade concrete floor slabs. There is provided a water/water vapor seal for welding to a conventional membrane liner resulting in a continuous seal at the termination points. The seal has three functionally distinct planes or edges connected at a common point, a first edge embedded into the lower foundation concrete acting as an anchor and to minimize any water, vapor, and/or gas migrating from underneath the membrane liner, a second edge positioned between the foundation concrete and upper or adjacent concrete slab that is used as a point for fastening, such as by welding, to the membrane liner, and a third edge embedded in the upper or adjoining concrete to minimize any water, vapor and/or gas penetrating the upper/lower concrete cold joint due to hydrostatic or gas pressure.

DRAWINGS

Figure 1:
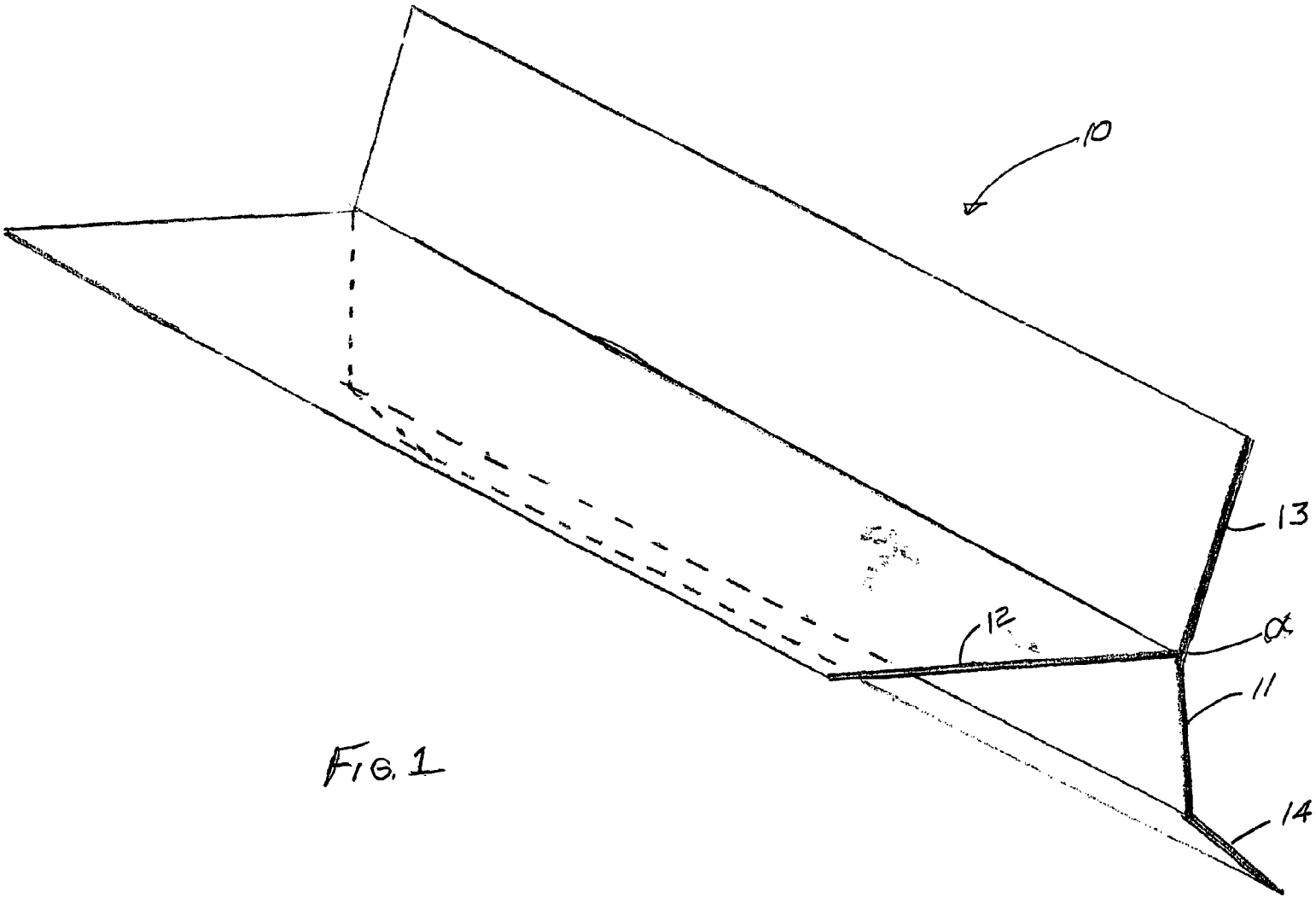
FIG. 1 is a perspective view of the water/vapor seal in accordance with the invention.
Figure 4:
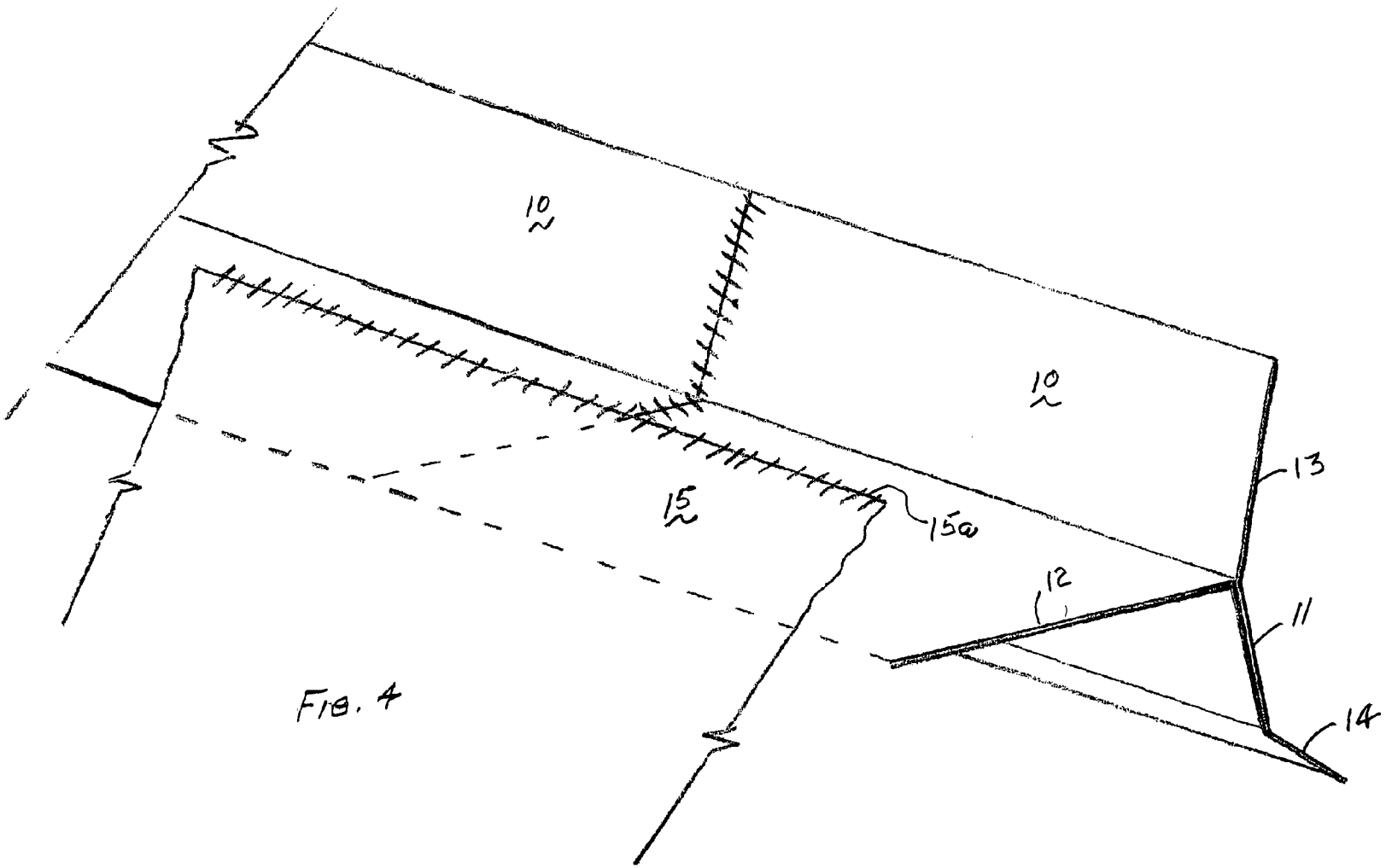
Figure 5:
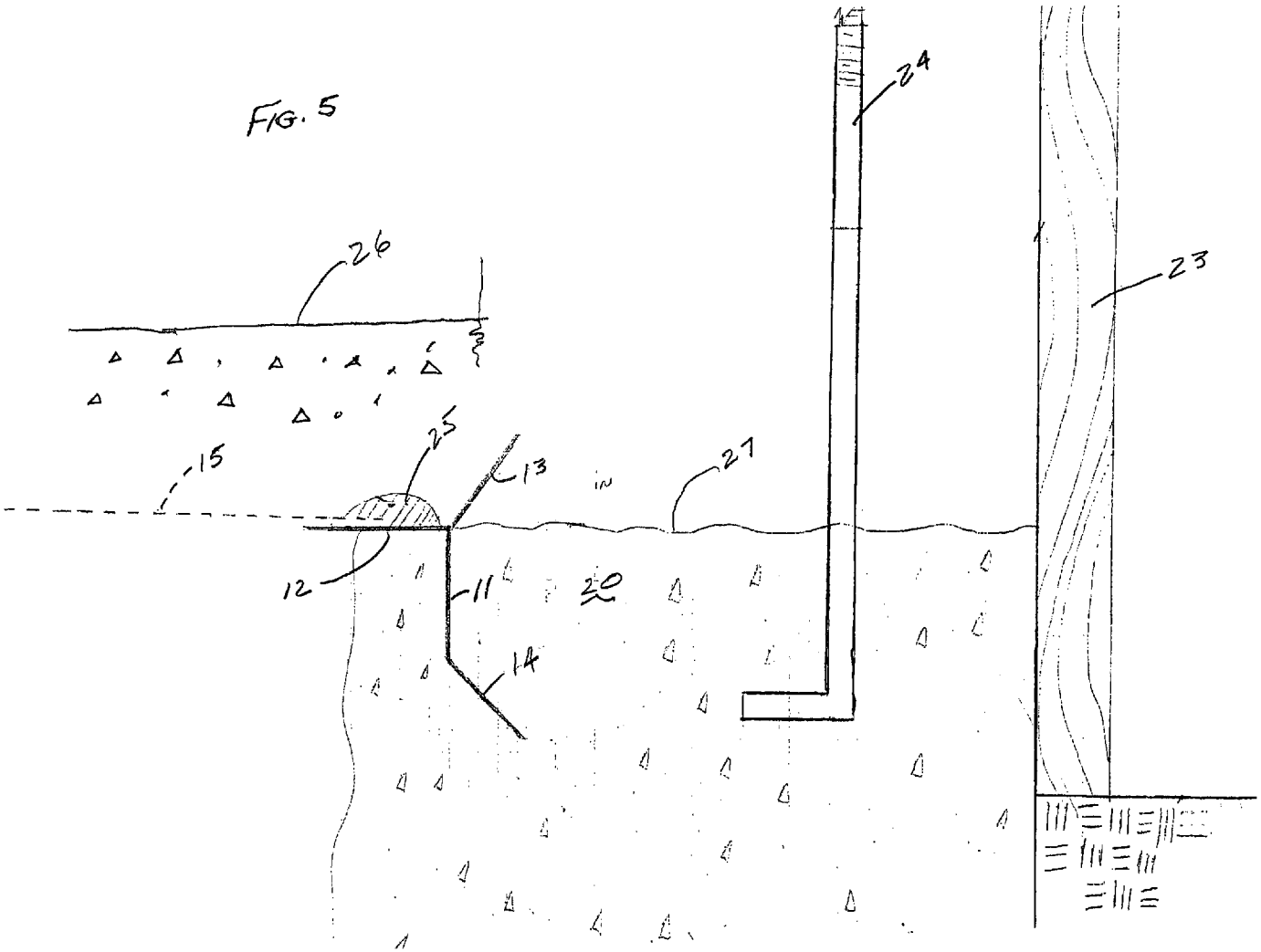
Figure 6:
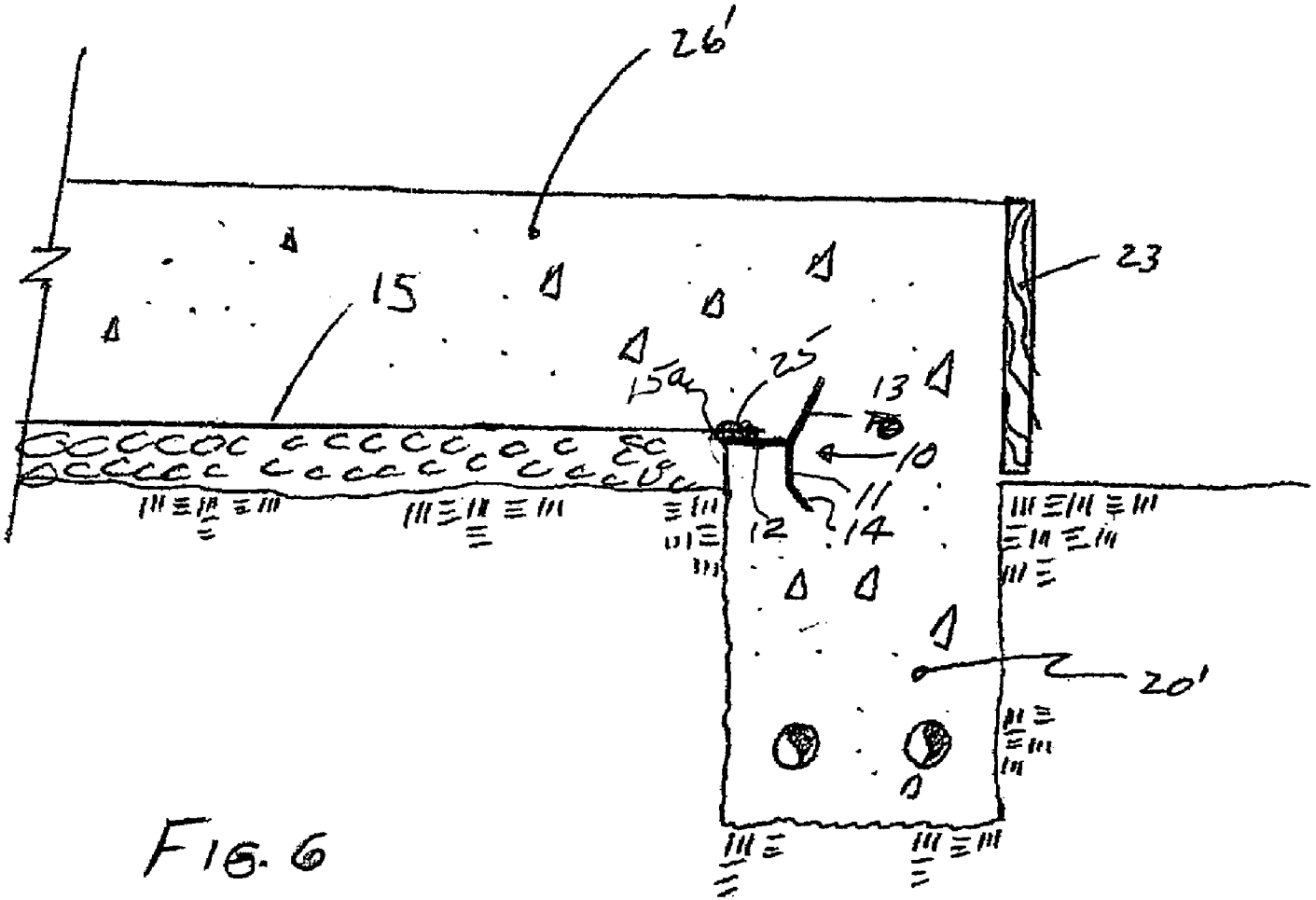

FIG. 4 FIG. 1 is a perspective view of the water/vapor seal of FIG. 1 illustrating welding thereto of a membrane liner in accordance with the invention;

FIG. 5 illustrates positioning of the welded membrane liner to the proper edge of the water/vapor seal in accordance with the invention in preparation for a concrete slab pour; and FIG. 6 illustrates in cross section a monolithic concrete pour wherein a foundation footing and a floor slab are poured at the same time.

DESCRIPTION

In accordance with the invention, apparatus and method is provided to improve protection against water, water vapor, and other vapors from entering into and permeating through a concrete slab to accumulate on top of the slab. A unique water/water vapor seal is provided for use at the foundation "cold joint" in conjunction with a conventional moisture barrier, or membrane liner. By fastening, such as by welding, of the membrane to the water/water vapor seal at the "cold joint", an improved termination point is provided that results in a continuous seal along the membrane. The fastening of the membrane liner to the water/water vapor seal creates a monolithic barrier between the sub-grade and slab for on grade or below grade foundations, minimizing water, water vapor, other liquids and gases that permeate through the concrete slabs and trans-evaporate back to a liquid.

Referring now to the drawings, the invention will be described in detail wherein the elements of the invention are identified by reference numerals, like reference numerals referring to like elements in the several views.

FIG. 1 is a perspective view of the water/vapor seal, generally designated 10, in accordance with the invention. As illustrated, the water/water vapor seal 10 has three primary functionally distinct planes or edges, that is, edges 11, 12, and 13, joining at a common point α. From the common point α, edge 11 and edge 12 are at approximately right angles with edge 13 at an obtuse angle of approximately 110 degrees from edge 12. As disclosed in the following description, in accordance with the invention, edge 12 is installed approximately horizontally from the common point with edge 11 installed approximately vertically downwardly therefrom. Edge 13 extends upwardly from the common point at the obtuse angle from edge 12 of approximate 110 degrees. Thus, edges 11 and 13 extend from the common point in opposite directions, edge 11 approximately vertically downward and edge 13 approximately 20 degrees from the vertical upwardly. A secondary edge 14 is shown depending downwardly from the end of edge 11 opposite from the common point, the function of which will be described below.

Typical dimensions for the edges are: one inch for edge 11, 2 inches for edge 12, and 1½ inch for edge 13. If edge 14 is used it is typically of one inch.

The seal 10 is typically formed in six-foot lengths of any suitable material that is compatible with fastening to the membrane liner 15 as will hereinafter be described. However, materials, dimensions, angles and the number of edges indicated or described herein are illustrative of a typical seal, but are subject to variation as the installation may require. Thus, although not shown, other embodiments with different configurations can be used depending on the water/water vapor barrier requirements of a particular job site.

Figure 2:
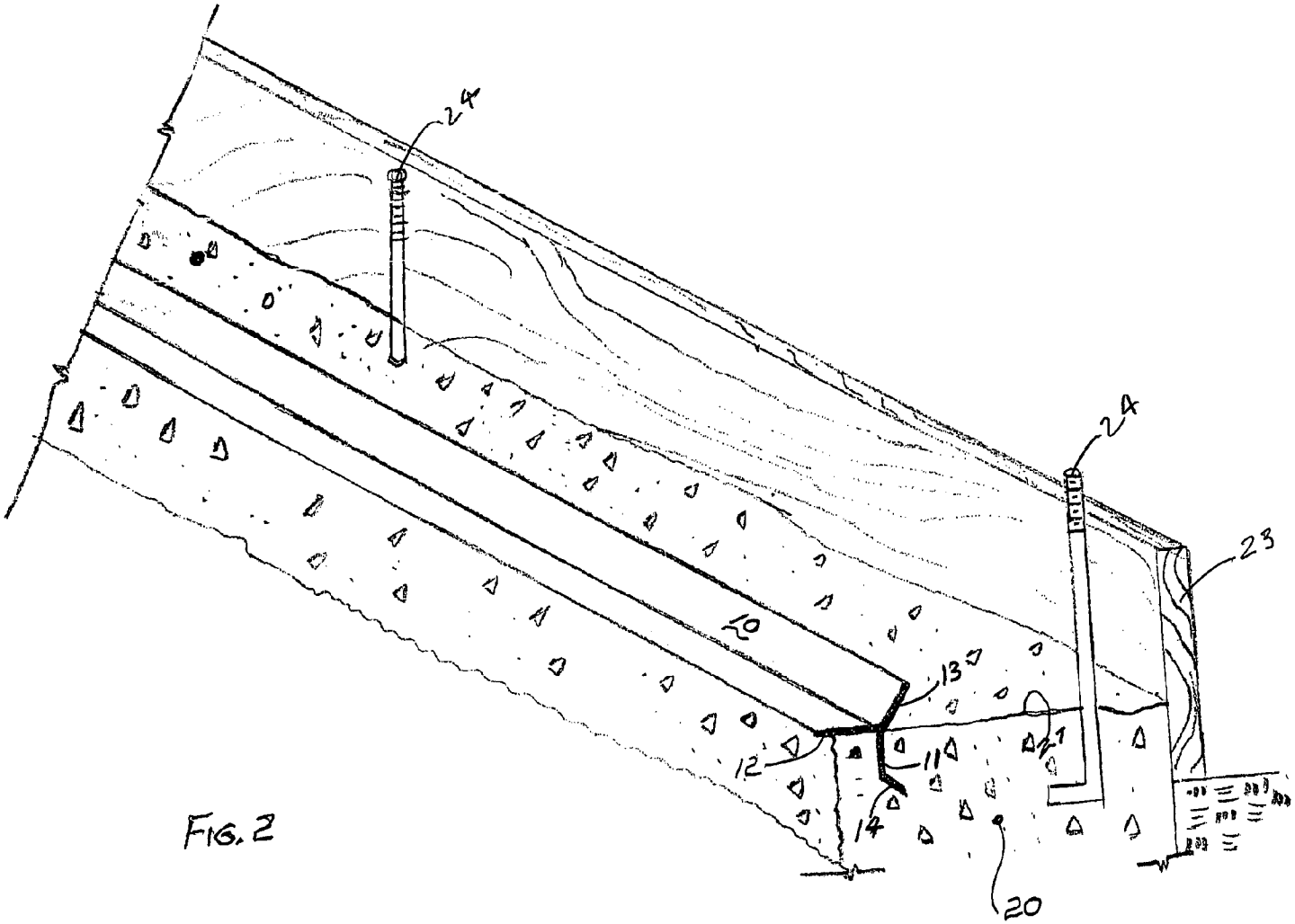
FIG. 2 illustrates a typical installation of the water/vapor seal of FIG. 1 within a footing prior to a concrete on grade slab pour in accordance with the invention.

FIG. 2 illustrates a typical installation of the water/vapor seal of FIG. 1 within a footing prior to a concrete slab pour. Primary edge 11 is embedded at pour into the lower layer foundational concrete 20 to form an anchor for the seal 10, edge 11 positioned in concrete 20 prior to or after the pour of concrete 20 such that edge 12 will extend substantially horizontally along the surface of concrete 20 to provide a platform to which the membrane 15 (see FIG. 4) is fastened and over which the surface concrete (not shown) is poured. Thus, edge 12 is positioned between the lower foundational concrete 20 and the upper surface concrete slab. Edge 12 additionally provides a guide for the installer to verify that the edge 11 is properly embedded in concrete 20.

Figure 3:
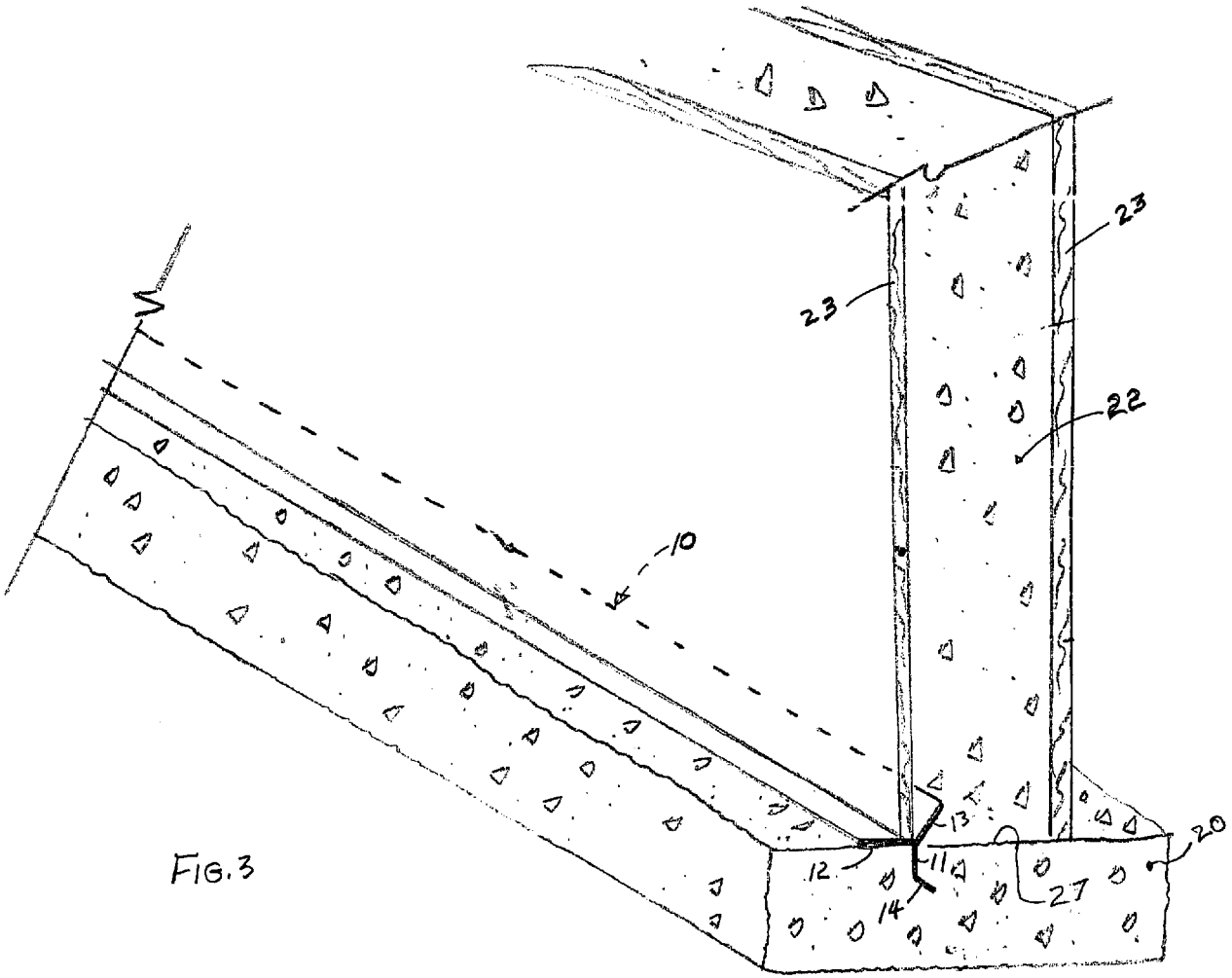
FIG. 3 illustrates the water/vapor seal installation of FIG. 3 after the concrete slab pour, typically used for basement construction.

Positioned in this manner edge 13 extends upwardly for embedding in a structure such as a concrete wall 22 as shown in FIG. 3, or within the concrete slab floor 26 as shown in FIG. 5. Secondary edge 14 may be included as a means for minimizing inadvertent "pull out" of edge 11 from the concrete 20. Also shown in FIG. 2 is concrete formwork 23 and anchor bolts 24.

FIG. 3 illustrates the water/vapor seal installation after the pour of a concrete wall 22 on top of a spread footing. As shown, edge 13 extends upwardly into concrete wall 22 at an appropriate obtuse angle from edge 12 to effectively serve as a "deflector" to deflect the flow of water, water vapor and/or gas migrating from foundation concrete 20 back toward the "cold joint" 27 between concrete 20 and wall concrete 22. The cold joint 27 presents the path of least resistance to the flow of water, water vapor and/or gas, thus this flow will be along the cold joint 27 and outward of the wall 22, or inward under the membrane liner 15 (see FIG. 5). The result is to minimize flow around edge 13 and thus to accumulate on top of the membrane 15 and thus to permeate through the surface slab as more clearly illustrated in FIG. 5.

FIGS. 2 & 3, in sequence, illustrate a non-monolithic pour in accordance with the invention where concrete footing 20 is first poured with the concrete wall 22 or concrete slab 26 poured second.

FIG. 4 is a perspective view illustrating fastening of membrane liner 15 to the water/vapor seal 10. Typical six-foot lengths of seal 10 are butted together lengthwise end-to-end and typically extrusion welded together to form the desired length in accordance with the desired length of the footing. The termination end 15*a* of liner 15 is positioned over edge 12 of seal 10 and typically extrusion welded along the termination end to edge 12.

The liner 15 is thus attached to edge 12 of the seal 10 in a manner to eliminate water, vapor or gas from penetration between the membrane 15 and the seal 10. Edge 13 minimizes the migration of water, vapor or gas from flowing around the seal 10. Where there is a propensity for such migration around seal 10, water vapor or gas will tend to escape at the cold joint 27 since cold joint 27 presents less resistance that the denser concrete 22. Further, edge 13 will act to deflect such migration to additionally force it back to the cold joint instead of trying to flow up and around concrete encapsulated edge 13.

The integrity of the connection of the termination end 15*a* of membrane liner 15 to seal 10 is critical in ensuring that the membrane liner 15 is an adequate water, water vapor and gas barrier. Adequate connection of the membrane liner 15 to the seal 10, as well as any necessary seaming of adjacent panels of liner 15 is typically accomplished by extrusion welding wherein for a plastic material such as HDPE, a molecular bond is created. Membrane liner seams between two material panels are first tack welded in place with hot air welding equipment, with seam areas then prepared for extrusion welding by sanding the surface oxidation and other contaminants in the seam areas. Extrusion welding equipment is then used to extrude a bead of molten material along the seam to weld the two pieces together.

Hot air welding is a simple procedure using a hand held hot air welding tool and a silicon rubber roller. The welder is equipped with a float air nozzle that distributes the hot air typically in a 1½" wide pattern. The nozzle is inserted between the overlap of the material and moved along the seam between the two materials to melt the materials together. A hand held roller is moved along the seam, the pressure and heat combination creating a molecular bond between the two materials.

In addition to extrusion welding, other appropriate means of fastening the liner membrane 15 to the water/vapor seal 10 can be used. For instance, heat welding, the use of glue or adhesive tape, or other appropriate procedures that would minimize water, vapor, or gas penetrating through the fastening mechanisms can be used.

It is important that the welded joint between the seal stop 10 and the membrane liner 15 does not experience undue stress such that the weld separates allowing water, vapor or gases to migrate between the seal 10 and the liner 15, and thus under any overlying slab. This problem is minimized where the seal 10 edge and the membrane liner is in the same horizontal plane. Where the seal 10 and the membrane liner 15 are in different planes, the weld is subjected to increased stress. Additionally, membrane liners are subject to temperature changes, that is, they will contract or shrink with a decrease in temperature and expand or stretch with an increase in temperature. A typical membrane liner will contract or expand approximately 2 inches with a temperature change of 30 degrees. Thus, the membrane liner 15 will typically be installed and fastened to the seal stop 10 during the day when ambient temperature is typically at its highest. The edges of the seal are designed so that at installation, the termination weld is at the same elevation as the liner so that when the liner is contracting during low temperatures the liners will not lift up and act like a trampoline. If the weld of an edge is installed higher than the membrane liner, lower temperature will tighten the liner and lift the weld or edge. Further, walking on top of the liner can stress the termination points of the liner such that it may stretch beyond acceptable limits, or even to tear, thus decreasing performance of the liner.

FIG. 5 is an end view illustrating a non-monolithic pour of a concrete slab 26 overlaying the membrane liner 15. Membrane liner 15 is welded, as indicated by welding bead 25, at termination end 15*a* to the seal 10 with edge 12 appropriately overlying footing 20. Edge 11 is embedded in concrete footing 20 and edge 13 is extending upwardly for encapsulation by pouring of concrete 26. The sequence of the installation is typically as follows:

1. The seal 10 is "wet set" into the perimeter of the internal concrete footings 20 during the footing installation.
2. After the utilities and sub-grade elevations are completed the membrane liner 15 is installed. The membrane liner 15 is installed in panels over pipe and utility penetrations and extrusion welded as previously described onto the seal 10. A boot liner flashing system is installed over all pipe and utility penetrations and extrusion welded into the liner 15. A bead of silicone caulking is installed as a bond between the pipe penetration and the liner boot. A stainless steal clamp is then fastened around the liner boot and pipe or utility penetration.
3. The termination 15*a* of the liner 15 is extrusion welded to the vapor seal 10.
4. Appropriate sand, typically one inch, is placed on top of the liner 15 and reinforcement steel is placed on top of the sand layer.
5. The overlying concrete slab 26 is poured and finished.

FIG. 6 is a cross sectional view illustrating a monolithic continuous concrete pour wherein the concrete slab 26', overlying membrane liner 15 is poured at the same time as the concrete foundation 20', resulting in elimination of a cold joint. As indicated in FIG. 6, seal 10 is positioned such that at completion of the monolithic pour, edge 11 is embedded in the concrete foundation 20' and edge 13 is extended at an angle upwardly and encapsulated by concrete 26'.

As previously disclosed, membrane liner 15 is welded at termination end 15*a* to the edge 12 of seal 10, edge 12 extending as appropriate past the vertical edge of the foundation 20' and into the area under slab 26' to join with membrane liner 15. The sequence of the monolithic installation is typically as follows:

1. After all concrete formwork, below grade utilities and sub-grade elevations are completed, membrane liner 15 is installed in panels as required and the panels welded together. A boot liner is installed at all penetration points of utility pipes into liner 15. A bead of silicone caulking is installed as a bond between each liner penetration and a stainless steel clamp fastened around the boot liner and pipe or utility penetration.
2. The termination 15*a* of the membrane liner 15 is extrusion welded to the seal 10, the seal 10 allowed to free stand over the concrete 20' pour.
3. Sand, typically one inch, is placed on top of the membrane liner 15 and reinforcement steel is placed on top of the sand layer and into the foundation 20' pour area.
4. The monolithic continuous concrete pour starts within the foundation 20' and continues to provide the slab 26', thereby eliminating a cold joint between foundation 20' and slab 26'.

Although the invention has been shown and described in conjunction with sealing at termination joints between a building foundation and the concrete slab, the concept of the invention would work equally well for water, vapor or gas barriers for walls made from concrete or blocks.

The apparatus and method of the present invention provides at least the following advantages over related prior art techniques.

1. Used as water/vapor stop between the cold joint of the footing and slab.
2. Increases effectiveness of the required vapor barrier liner.
3. Ensures maximum water/vapor protection at the liner termination.
4. Reduces installation time of the liner seam at the liner termination.
5. Does not alter concrete contractor construction procedures in the field.
6. Reduces potential for mold growth at the liner termination by reducing excessive moisture entering from perimeter of the structure form drainage, irrigation, etc.
7. Eliminates less effective vapor barriers normally positioned beneath the perimeter footing of the structure.
8. Compatible with the more effective current water/vapor barrier liners.
9. Eliminates the liner "trampoline" effect due to temperature changes
10. Minimizes peeling stress of the weld between the seal and the liner.
11. Eliminates creasing of the liner or sharp bending of the liner.
12. Insect/bug control.
13. Provides easier building inspector verification of quality control/assurance.

The invention has been described with respect to specific details. However, it is understood that variations will be apparent to those skilled in the art, thus, it is not intended that such details limit the scope and coverage of the invention.

What is claimed is:

1. Concrete foundation structure comprising:

a concrete foundation;

an upper concrete structure;

a membrane located between said foundation and said structure;

a means for preventing migration of subsurface moisture said moisture preventing means including a common junction having multi-edges extending therefrom;

a first edge fastened in a moisture proof manner to said membrane over which said concrete structure is poured;

a second edge extending downwardly below said membrane to be embedded in said foundation to prevent migration of said moisture from below said membrane and around said moisture preventing means; and a third edge extending upwardly above said membrane to be embedded in said upper structure to prevent migration of moisture into said upper concrete structure said first edge of said moisture preventing means is positioned in generally the same plane as said membrane, said second edge extends downwardly from said first edge at substantially a right angle, and said third edge extends upwardly from said first edge at an obtuse angle.

2. The improved seal of claim 1 wherein a fourth edge extends angularly from the end of said second edge to minimize pull out of said second edge from said underlying footing to thereby provide increased position stability of said seal.

3. The concrete foundation structure of claim 1 wherein at least the material at the point of attachment of said first edge and the material of said membrane are welding compatible.

4. A method of constructing a concrete foundation comprising:

providing a concrete foundation and an upper concrete structure;

positioning a membrane between said concrete foundation and said upper concrete structure;

providing a means for preventing migration of sub-surface moisture and gas into an upper concrete structure;

positioning said means to coact with said membrane to prevent migration of moisture and gas around said membrane to permeate said upper concrete structure, said moisture preventing means including a common junction having multi-edges extending therefrom;

a first edge fastened in a moisture proof manner to said membrane over which said concrete structure is poured;

a second edge extending downwardly below said membrane to be embedded in said foundation to prevent migration of said moisture and gas from below said membrane and around said moisture preventing means; and a third edge extending upwardly above said membrane to be embedded in said upper structure to prevent migration of said moisture and gas into said upper concrete structure wherein said first edge of said moisture preventing means is positioned in generally the same plane as said membrane, said second edge extends downwardly from said first edge at substantially a right angle and is positioned in said foundation below said membrane to prevent migration of said moisture and gas from below said membrane and around said moisture preventing means, and said third edge extends upwardly from said first edge at an obtuse angle and is positioned to prevent migration of said moisture and gas into said upper concrete structure.

5. The method of claim 4 wherein said seal further includes a fourth edge extending angularly from the end of said second edge to minimize pull out of said second edge from said foundation to thereby provide increased position stability of said seal.

* * * * *